US007688174B2

(12) United States Patent
Hung

(10) Patent No.: US 7,688,174 B2
(45) Date of Patent: Mar. 30, 2010

(54) OVERLOAD PROTECTION SWITCH

(75) Inventor: Tang-Yueh Hung, Taichung Hsien (TW)

(73) Assignee: Zing Ear Enterprise Co., Ltd., Taichung Hsien (TW)

( * ) Notice: Subject to any disclaimer, the term of this patent is extended or adjusted under 35 U.S.C. 154(b) by 108 days.

(21) Appl. No.: 12/189,961

(22) Filed: Aug. 12, 2008

(65) Prior Publication Data

US 2010/0039209 A1 Feb. 18, 2010

(51) Int. Cl.
*H01H 37/70* (2006.01)
*H01H 37/52* (2006.01)

(52) U.S. Cl. ..... 337/66; 337/56; 337/72

(58) Field of Classification Search ..... 337/56, 337/72, 66; 200/339, 341
See application file for complete search history.

(56) References Cited

U.S. PATENT DOCUMENTS 3,932,829 A * 1/1976 Ellenberger ..... 337/49
4,258,349 A * 3/1981 Flory ..... 337/46
4,329,669 A * 5/1982 Krasser et al. ..... 335/20
4,338,586 A * 7/1982 Scanlon ..... 337/74
4,345,233 A * 8/1982 Matthies ..... 337/75
4,528,538 A * 7/1985 Andersen ..... 337/43
4,833,439 A * 5/1989 Bowden et al. ..... 337/68
4,922,219 A * 5/1990 Bakhaus et al. ..... 337/74
5,089,799 A * 2/1992 Sorenson ..... 337/68
5,223,813 A * 6/1993 Cambreleng et al. ..... 337/66
5,264,817 A * 11/1993 Sorenson ..... 337/68
5,491,460 A * 2/1996 Krasser et al. ..... 337/70
5,760,672 A * 6/1998 Wang ..... 337/79
5,828,284 A * 10/1998 Huang ..... 337/37
5,892,426 A * 4/1999 Huang ..... 337/59
5,933,069 A * 8/1999 Huang ..... 337/66
6,121,868 A * 9/2000 Chiang ..... 337/37
6,275,134 B1 * 8/2001 Chen ..... 337/37
6,307,460 B1 * 10/2001 Yu ..... 337/37
6,445,273 B1 * 9/2002 Yu ..... 337/37
6,456,185 B1 * 9/2002 Yu ..... 337/37
6,512,441 B1 * 1/2003 Yu ..... 337/37
6,552,644 B2 * 4/2003 Yu ..... 337/66
6,563,414 B2 * 5/2003 Yu ..... 337/66
6,617,952 B1 * 9/2003 Yu ..... 337/94
6,621,402 B2 * 9/2003 Huang ..... 337/66
6,664,884 B1 * 12/2003 Yu ..... 337/59
6,674,033 B1 * 1/2004 Wang ..... 200/334
6,714,116 B1 * 3/2004 Sang et al. ..... 337/68
6,734,779 B2 * 5/2004 Yu ..... 337/59

(Continued)

FOREIGN PATENT DOCUMENTS

CH 647094 A5 * 12/1984

*Primary Examiner*—Anatoly Vortman
(74) *Attorney, Agent, or Firm*—Ming Chow; Sinorica, LLC

(57) ABSTRACT

An overload protection switch includes a main body and a press button. Several terminals, a conductive plate and other components are arranged in the main body. By means of switching the press button, the switch is switchable between an on state and an off state. In case of overload, the conductive plate will separate from one of the terminals to switch off the switch. The components arranged in the main body will not hinder the conductive plate from separating from the terminal. When switching on the switch, the conductive plate resiliently contacts the terminal. In case of overload, the conductive plate separates from the terminal to switch off the switch so as to provide overload protection effect.

14 Claims, 10 Drawing Sheets

U.S. PATENT DOCUMENTS 6,788,186 B1 * 9/2004 Yu ..... 337/66
7,248,140 B2 * 7/2007 Yu ..... 337/94
7,292,129 B2 * 11/2007 Yu ..... 337/66
7,317,375 B2 * 1/2008 Yu ..... 337/94
2003/0160679 A1 * 8/2003 Yu ..... 337/37
2004/0036570 A1 * 2/2004 Yu ..... 337/59
2006/0273875 A1 * 12/2006 Huang ..... 337/66

* cited by examiner

OVERLOAD PROTECTION SWITCH

BACKGROUND OF THE INVENTION

The present invention is generally related to a switch, and more particularly to an overload protection switch.

A switch is used to control closing/opening of a circuit. Great current is likely to result in overload, which may cause danger. A switch with overload protection function is able to avoid overload of a circuit so as to avoid danger.

Many kinds of overload protection switches are commercially available. It is tried by the applicant to provide an overload protection switch, which has novel structure and can be more conveniently used.

SUMMARY OF THE INVENTION

It is therefore a primary object of the present invention to provide an overload protection switch, which is able to provide overload for a circuit.

It is a further object of the present invention to provide an overload protection switch. In case of overload, even if the press button of the switch is positioned in an on position, the switch can still automatically switch off to cut off the power.

It is still a further object of the present invention to provide an overload protection switch, which includes an internal light emitter. By means of observing whether the light emitter is turned on or off, a user can judge whether the switch is switched on or off.

According to the above objects, the overload protection switch of the present invention includes a main body, at least two terminals, a conductive plate, a slide block, a transmission mechanism and a resilient guide member. A press button is disposed on a top end of the main body. The terminals and the above components are arranged in the main body. The conductive plate is a bimetal plate structure. One end of the conductive plate is fixedly connected with a first terminal, while another end of the conductive plate is a contact end, which is vertically swingable. The guide member has a located end located in the main body and a movable end connected with the contact end of the conductive plate; the guide member is resiliently extensible between the two ends. When the press button is positioned in an off position, the slide block is urged by a resilient member and positioned in a home position and the movable end of the guide member is higher than the located end thereof. In this state, the contact end of the conductive plate is not in contact with the second terminal. When switching the press button from the off position to an on position, the transmission mechanism drives the slide block to move downward and the slide block pushes the guide member to move the movable end thereof downward. When the movable end of the guide member becomes lower than the located end thereof, the guide member resiliently extends to make the movable end move downward so that make the contact end of the conductive plate to contact the second terminal and close the circuit. At the same time, the slide block is released from the pushing of the transmission mechanism and pushed by the resilient member to restore to its home position and the slide block is separated from the guide member by a certain distance without pressing the guide member, permitting the guide member and the conductive plate to move upward.

Due to the conductive plate resiliently contacts the second terminal without being pressed by the slide block, in case of overload, the contact end of the conductive plate will automatically bend up to separate from the second terminal and drive the movable end of the guide member to move upward to a position higher than the located end. The press button and the slide block will not hinder the conductive plate from separating from the second terminal. Therefore, in case of overload, even if the press button of the switch is positioned in the on position, the switch can still switch off to cut off the power.

A light-emitting element is further disposed in the main body of the switch and connected to the terminals. When switched on, the light-emitting element emits light. When switched off, the light-emitting element is extinguished.

The present invention can be best understood through the following description and accompanying drawings wherein:

BRIEF DESCRIPTION OF THE DRAWINGS

FIGS. 8 to 11 are front views showing the operation of the preferred embodiment of the present invention, wherein FIG. 8 shows that the switch is switched off;

FIG. 9 shows that the switch is about to be switched on;

FIG. 10 shows that the switch is switched on;

FIG. 11 shows that the switch automatically switches off in the case of overload;

DETAILED DESCRIPTION OF THE PREFERRED EMBODIMENTS

Figure 1:
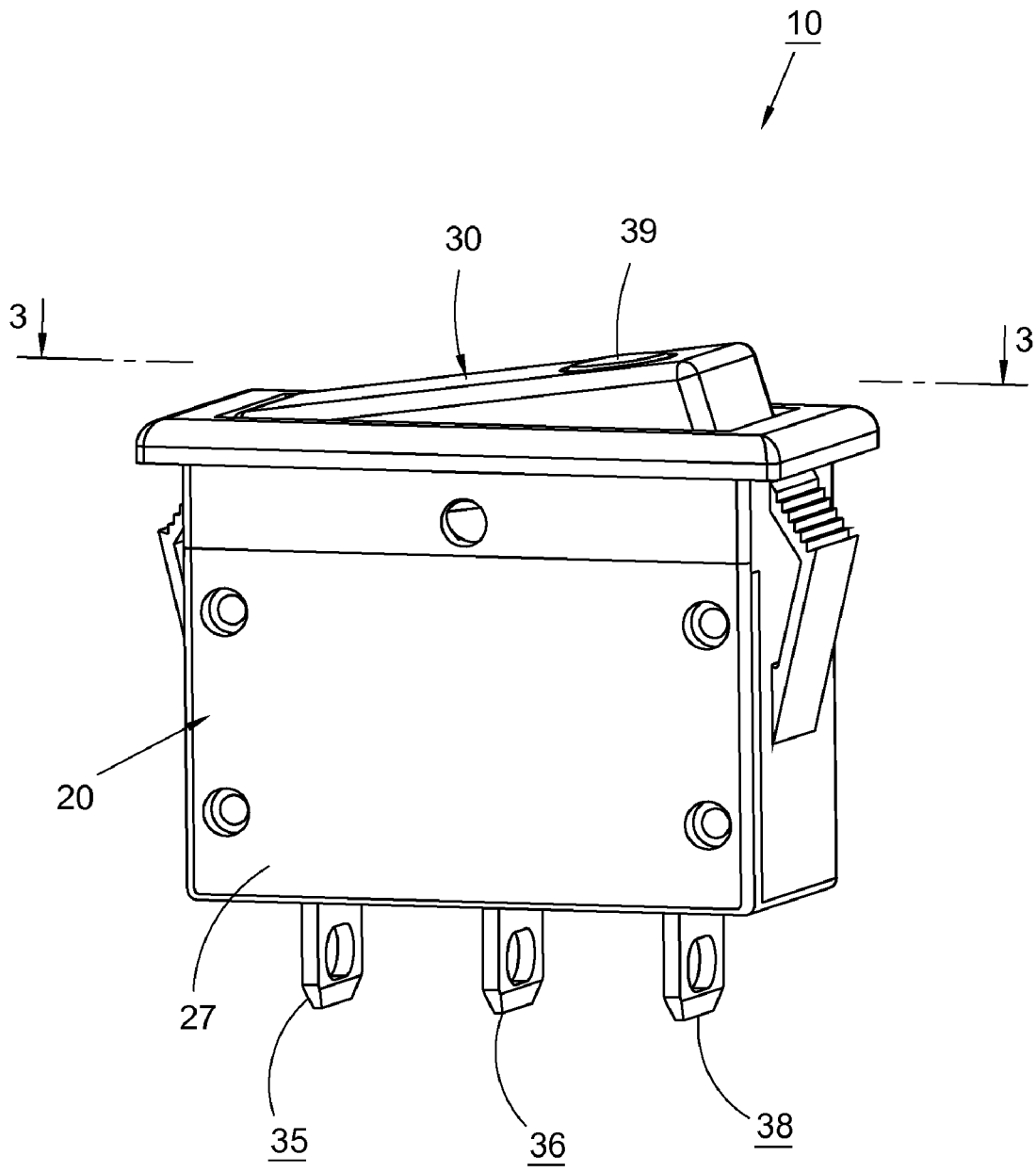
FIG. 1 is a perspective assembled view of a preferred embodiment of the present invention.
Figure 2:
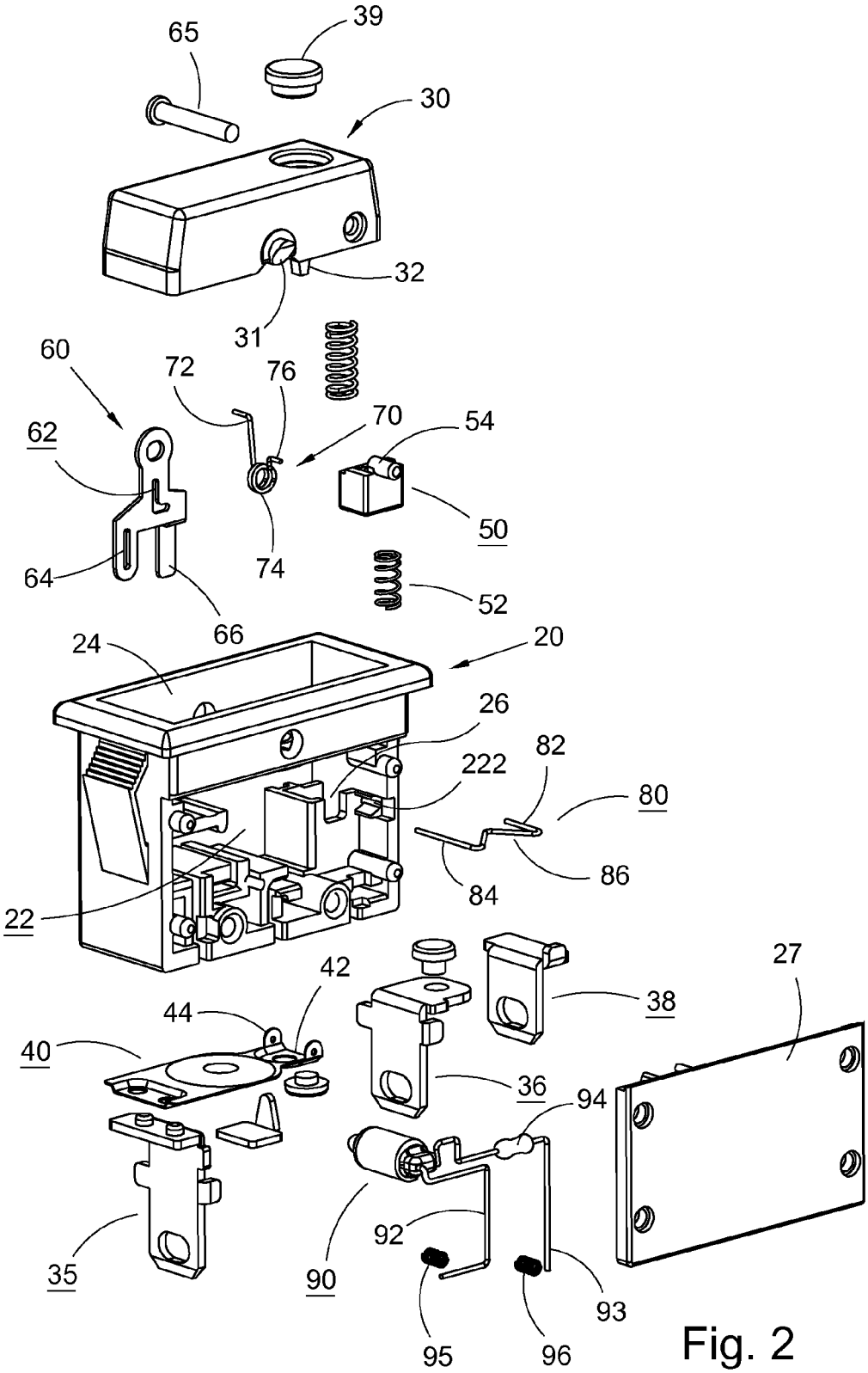
FIG. 2 is a perspective exploded view of the preferred embodiment of the present invention according to FIG. 1.

Please refer to FIGS. 1 and 2. According to a first embodiment, the overload protection switch 10 includes a main body 20, a press button 30 and components arranged in the main body 20.

The main body 20 has an internal space 22 and an opening 24 on a top face. The opening 24 communicates with the space 22. A slide way 26 is disposed in the space 22.

The press button 30 is pivotally disposed in the opening 24 of the main body 20 via a rotary shaft section 31. When pressed, the press button 30 is angularly displaced about the rotary shaft section 31. A shifting section 32 is disposed under a bottom face of the press button 30 and downward projects therefrom.

Figure 3:
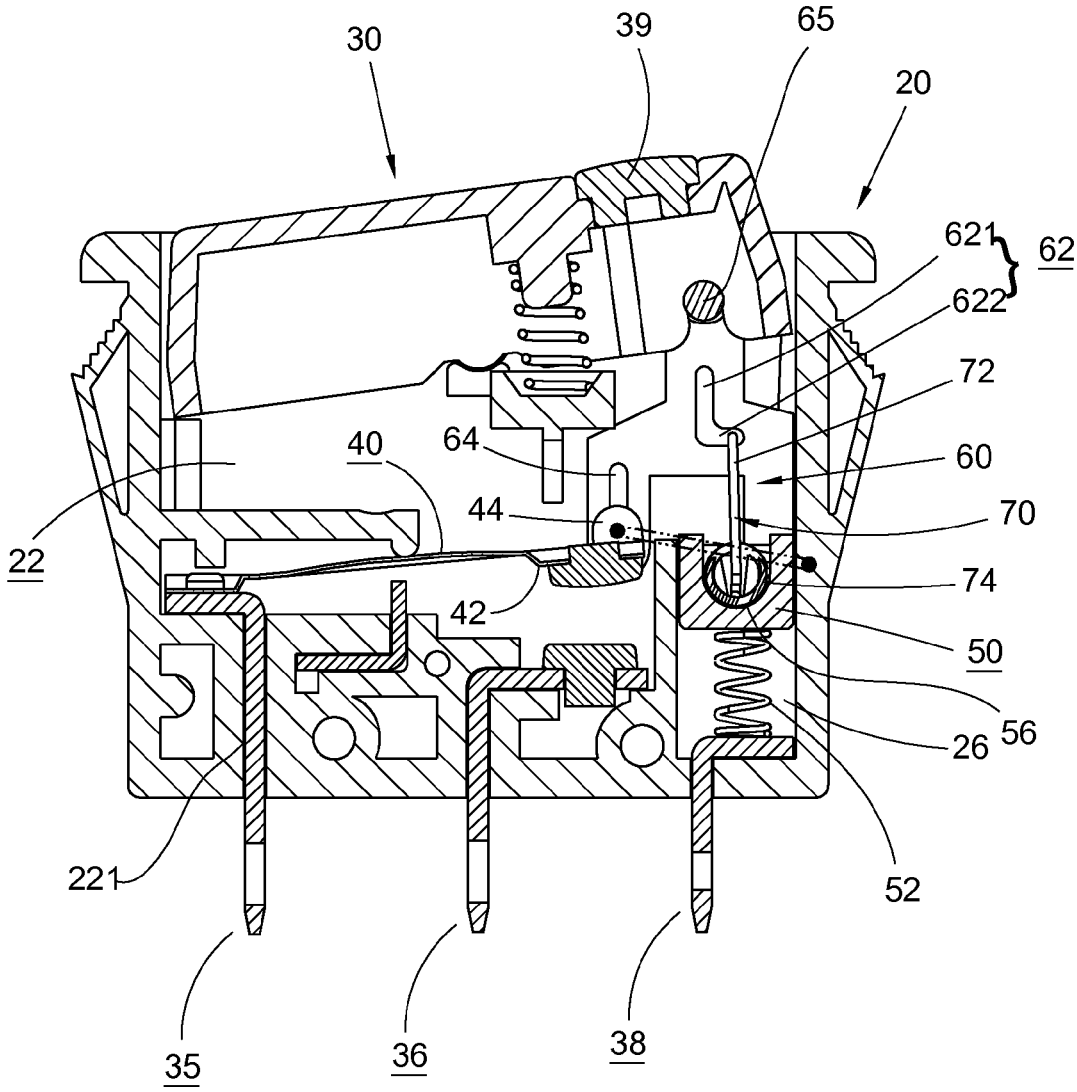
FIG. 3 is a sectional view taken along line 3-3 of FIG. 1.

Referring to FIG. 3, a first terminal, a second terminal and a third terminal 35, 36, 38 are disposed in insertion slots 221 of the main body 20. Bottom ends of the terminals outward protrude from the main body 20. The first and third terminals 35, 38 are positioned on two sides of the main body, while the second terminal 36 is positioned between the first and third terminals.

A conductive plate 40, which is a bimetal plate structure. The two metal plates of the conductive plate 40 have different expansion coefficients. One end of the conductive plate 40 is fixedly connected with the first terminal 35, while another end of the conductive plate 40 is a contact end 42, which is freely swingable and positioned above the second terminal 36.

A slide block 50 is disposed in the slide way 26 and slidable along the slide way 26. A bottom end of the slide block 50 is pushed by a resilient member 52, whereby the slide block 50 is always urged upward in normal state. A push section 54 is disposed on a front face of the slide block 50.

A transmission mechanism includes a transmission member 60 and a linking member 70.

Figure 5:
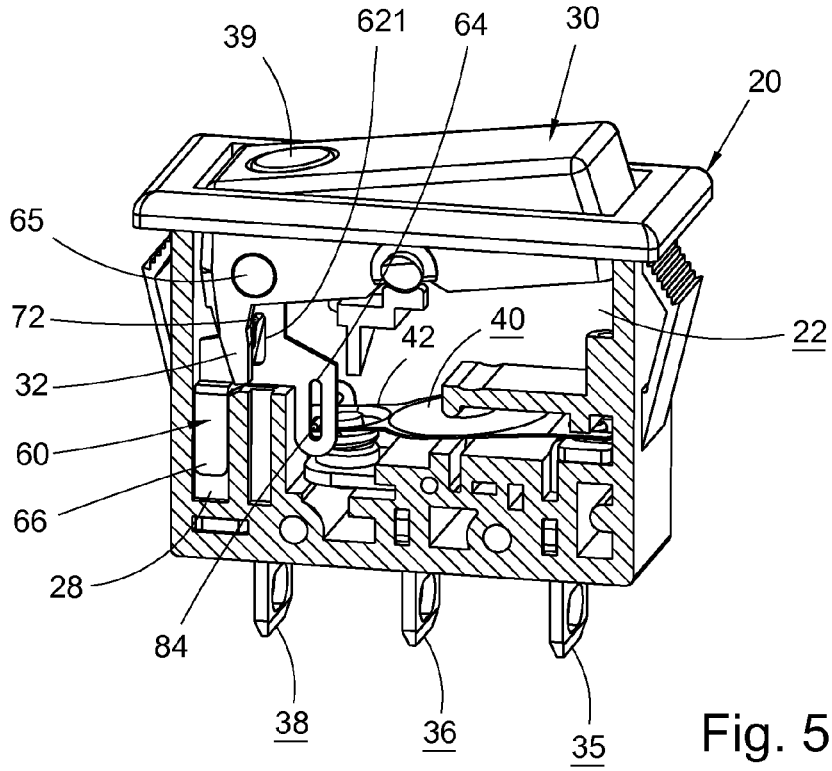
FIG. 5 is a rear perspective partially sectional view showing internal structure of the preferred embodiment of the present invention.

The transmission member 60 is plate-like, having a transmission slot 62 and a straight slot 64. In this embodiment, the transmission slot 62 is L-shaped, including a vertical slot section 621 and a transverse slot section 622 communicating with a bottom end of the vertical slot section. A top end of the transmission member is pivotally connected with the press button 30 via a pin 65, whereby the transmission member is displaceable along with the press button. Referring to FIG. 5, the transmission member 60 has a plate section 66 inserted in an insertion slot 28 of the main body 20, whereby when moved up and down, the transmission member 60 is hindered from deflecting.

The linking member 70 has an operation end 72. The linking member is substantially connected with the slide block 50 by being located on the slide block or pivotally connected with the slide block. The operation end 72 extends into the transmission slot 62 of the transmission member 60, and the operation end is resiliently restorable. When no external force is applied to the linking member 70, the operation end 72 is always urged to horizontally move in a fixed direction.

Figure 6:
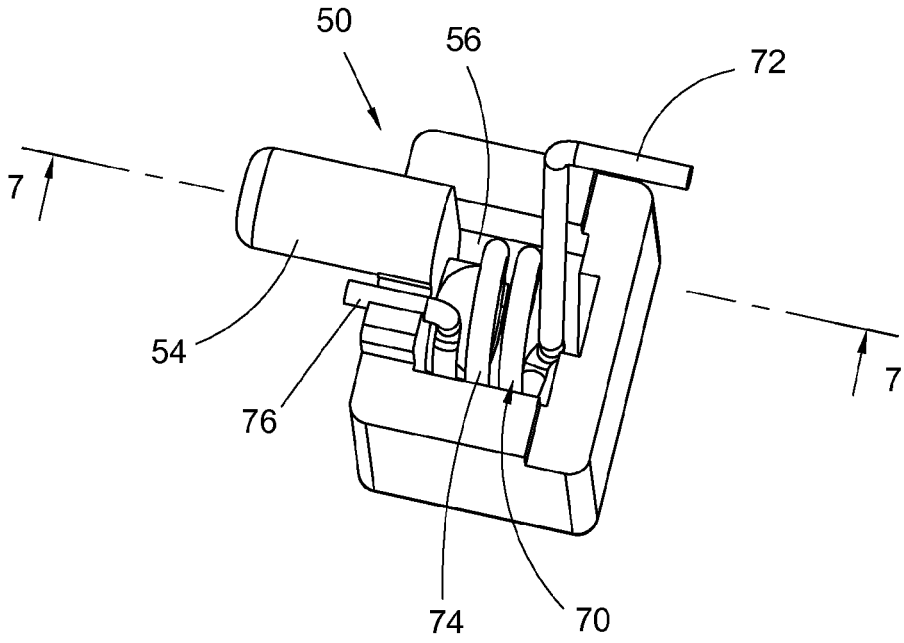
FIG. 6 is a perspective view showing the linking member and slide block of the preferred embodiment of the present invention.
Figure 7:
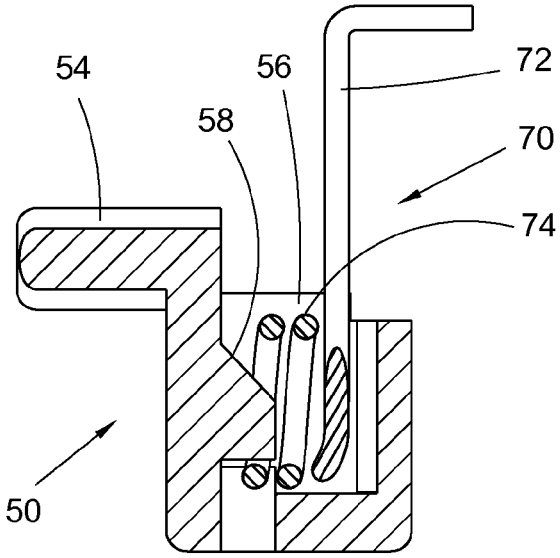
FIG. 7 is a sectional view taken along line 7-7 of FIG. 6.

In this embodiment, the linking member is a torque spring having a coiled section 74, and a first leg and a second leg connected with the coiled section. The coiled section 74 of the torque spring is positioned in a recess 56 formed on a top face of the slide block 50 and latched with a projecting block 58 of the slide block 50 as shown in FIGS. 3, 6 and 7. The first leg 76 of the torque spring is connected with the slide block 50. The second leg serves as the operation end 72. The first leg 76 is fixed with the slide block, whereby the second leg, that is, the operation end, can resiliently swing so that the horizontal resilient restoring force of the operation end is achieved.

Figure 8:
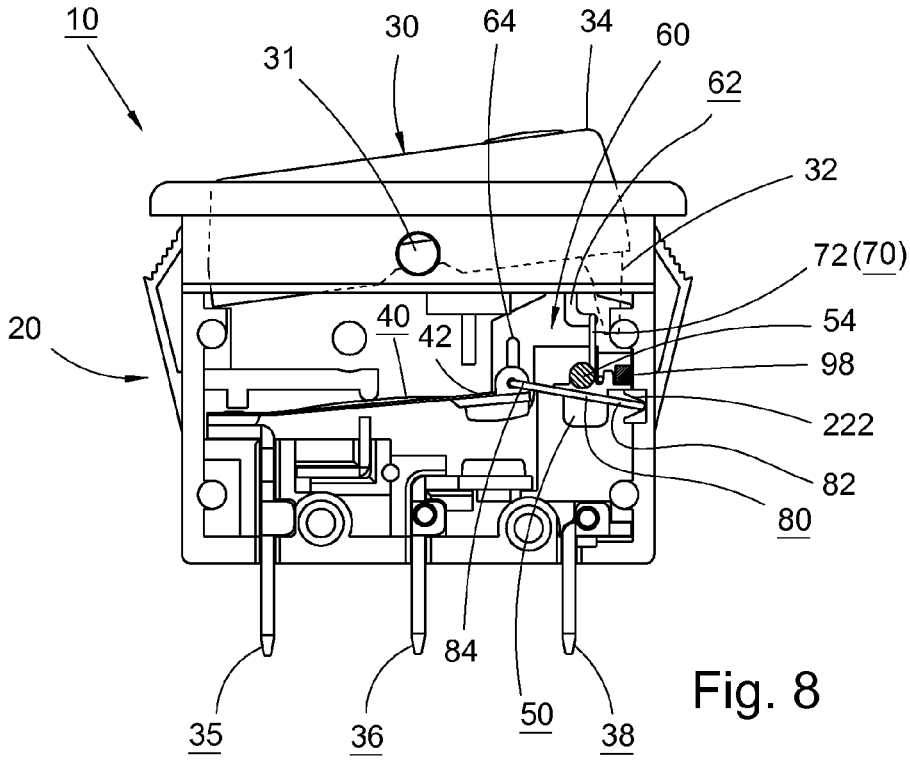

A resilient guide member 80, preferably is a resilient elongated member. One end 82 of the guide member 80 is located on or pivotally disposed on an inner face of a wall of the main body 20, for example, a locating section 222 as shown in FIG. 8. The other end 84 of the guide member 80 is a movable end pivotally connected with lugs 44 of the contact end 42 of the conductive plate 40, and the movable end 84 extends into the straight slot 64 of the transmission member 60. The guide member 80 is lengthwise resiliently extensible between the two ends. Preferably, the guide member 80 has a bent section 86 disposed between the ends as shown in FIG. 2, by means of which the guide member 80 is lengthwise resiliently extensible.

In addition, the contact end 42 of the conductive plate 40 can be up and down swung by a certain travel. In height, the located end 82 of the guide member 80 is positioned between an upper dead end and a lower dead end of the swinging travel of the conductive plate.

Figure 9:
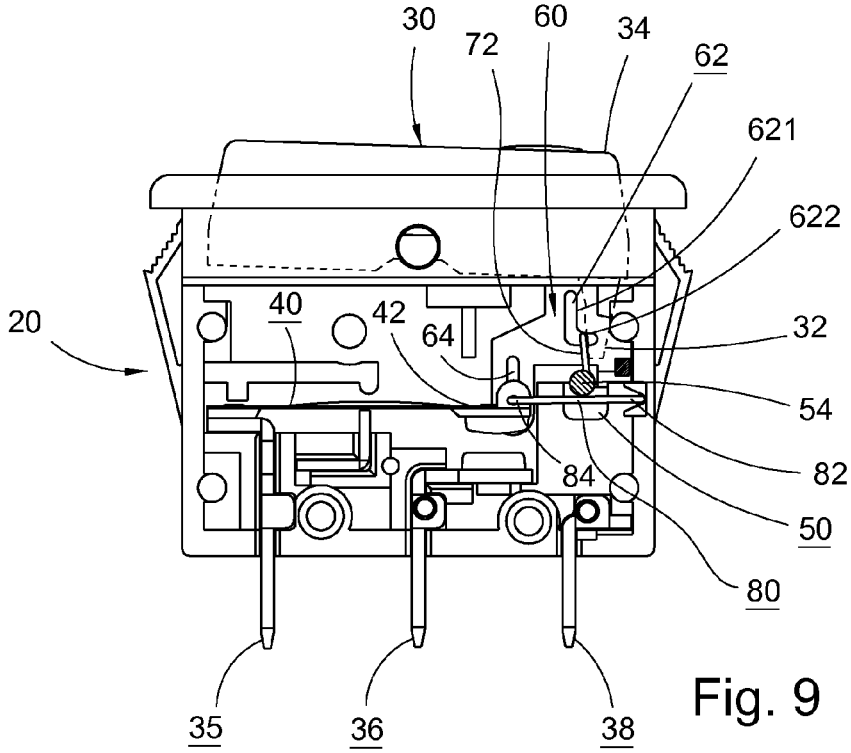
Figure 10:
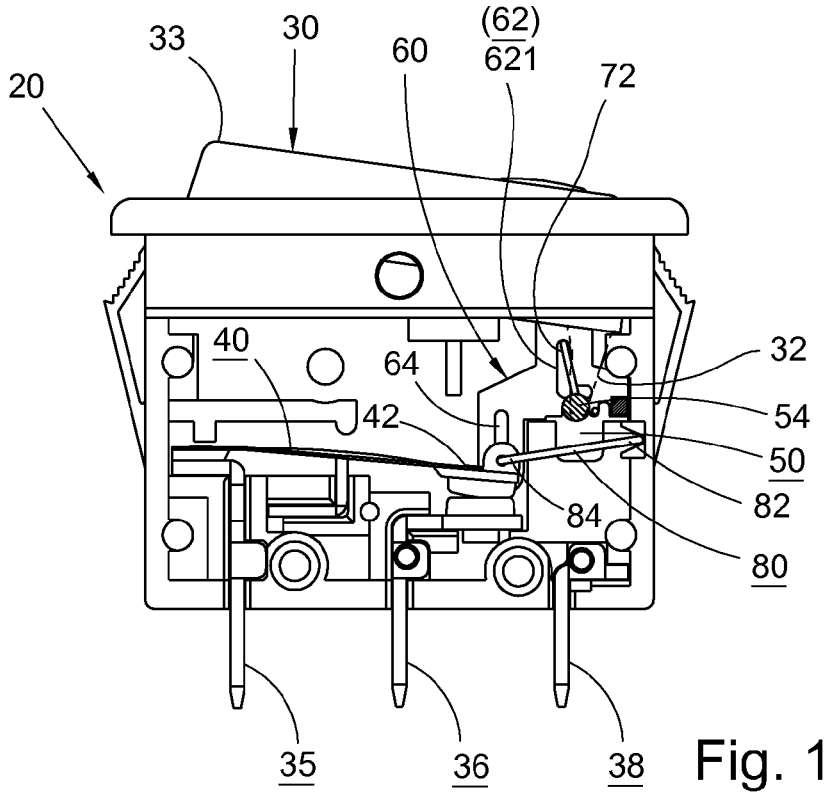

FIGS. 8 to 10 show the operation of the present invention. In order to facilitate identification, the push section 54 of the slide block 50 is sectionally shown. Referring to FIGS. 3 and 8, when the press button 30 is positioned in an open position, the transmission member 60 is positioned in a higher position, that is, home position. In this state, the operation end 72 of the linking member 70 is positioned in the transverse slot section 622 of the transmission slot 62. The movable end 84 of the guide member 80 is positioned at the bottom end of the straight slot 64 and higher than the located end 82 thereof. The contact end 42 of the conductive plate 40 is lifted without contacting the second terminal 36. Accordingly, the switch 10 is in an off state.

When switching on the switch 10, the press button is pressed from the off state through the state of FIG. 9 into an on state as shown in FIG. 10. At this time, the conductive plate 40 contacts the second terminal 36 to switch on the switch 10. This will be described in detail hereinafter.

When switching on the switch 10, a second end 34 of the press button 30 is pressed to urge the transmission member 60 downward. At this time, the operation end 72 of the linking member 70 is still positioned in the transverse slot section 622 of the transmission slot 62. Therefore, the linking member 70 is driven by the transmission member 60 to move downward and push the slide block 50 downward. When the slide block 50 moves downward, the push section 54 of the slide block 50 pushes the guide member 80 to move the movable end 84 thereof downward at the same time. At this time, the contact end 42 of the conductive plate 40 is urged to move downward. When the movable end 84 of the guide member 80 moves downward, a distance between the two ends of the guide member is shortened to conserve an elastic potential energy. Meanwhile, when the press button 30 is pressed, the shifting section 32 of the press button 30 touches and pushes the operation end 72 of the linking member 70 as shown in FIG. 9, therefore, the operation end 72 is urged to gradually move from a closed end of the transverse slot section 622 toward the vertical slot section 621.

When the switch 10 is further operated from the state of FIG. 9, the push section 54 of the slide block 50 further downward pushes the guide member 80. When the movable end 84 of the guide member 80 becomes lower than the located end 82 thereof, the guide member 80 will resiliently extend, and the resilient extension makes the movable end 84 of the guide member 80 automatically move toward the bottom end of the straight slot 64 of the transmission member 60, and the movable end 84 urges the contact end 42 of the conductive plate 40 to move downward and contact the second terminal 36 so as to switch on the switch 10. Then, the shifting section 32 of the press button 30 pushes the operation end 72 of the linking member 70 into the vertical slot section 621 of the transmission slot 62 of the transmission member 60. At this time, the linking member 70 is no more restricted within the transverse slot section 622 and the resilient member 52 (shown in FIG. 3) upward pushes the slide block 50 and the linking member 70. Under such circumstance, the operation end 72 of the linking member 70 moves along the vertical slot section 621 to a top end thereof.

Figure 4:
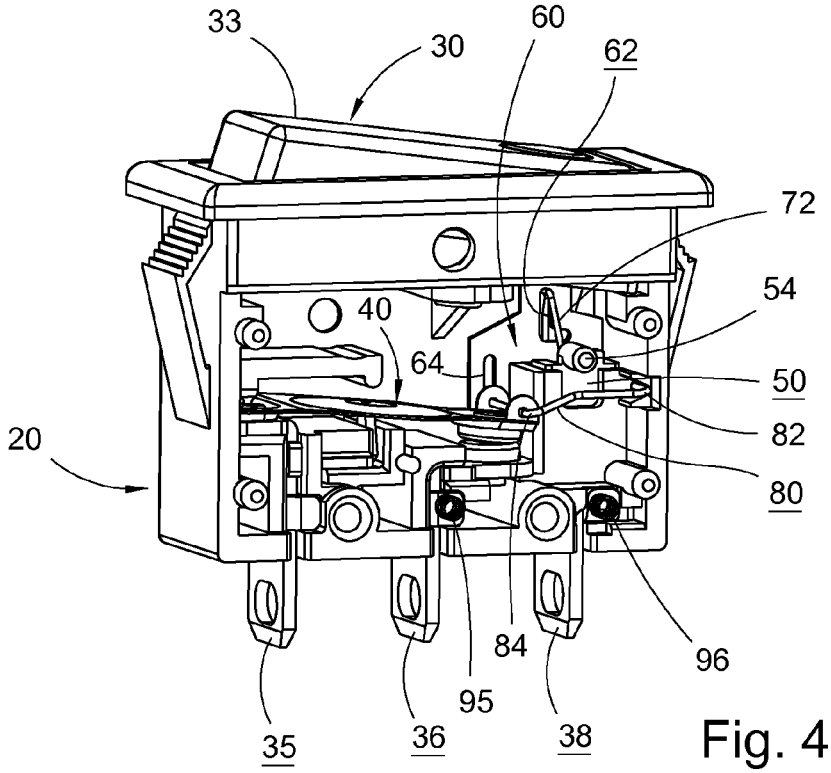
FIG. 4 is a front perspective view showing internal structure of the preferred embodiment of the present invention.

FIGS. 4, 5 and 10 show that the switch 10 is switched on. In this state, the movable end 84 of the guide member 80 is positioned at the bottom end of the straight slot 64 of the transmission member 60, while the slide block 50 is restored to its home position where the push section 54 is spaced from the guide member 80 by a considerable distance without pressing the guide member 80.

By means of pressing a first end 33 of the press button 30 to restore the press button 30 to the off position, the switch 10 can be restored to the open state of FIG. 8. The operation process is as follows:

The transmission member 60 is pulled by the press button 30 to move upward. At this time, the movable end 84 of the guide member 80 is urged upward and the contact end 42 of the conductive plate 40 is at the same time moved upward to separate from the second terminal 36. After the transmission member 60 is restored to its home position, the operation end 72 of the linking member 70 is moved to the bottom end of the vertical slot section 641. At this time, the shifting section 32 of the press button 30 does not contact with the operation end 72. Therefore, due to the resilient restoring force of the linking member 70, the operation end 72 will automatically move back into the transverse slot section 622 and restore to the open state.

Figure 11:
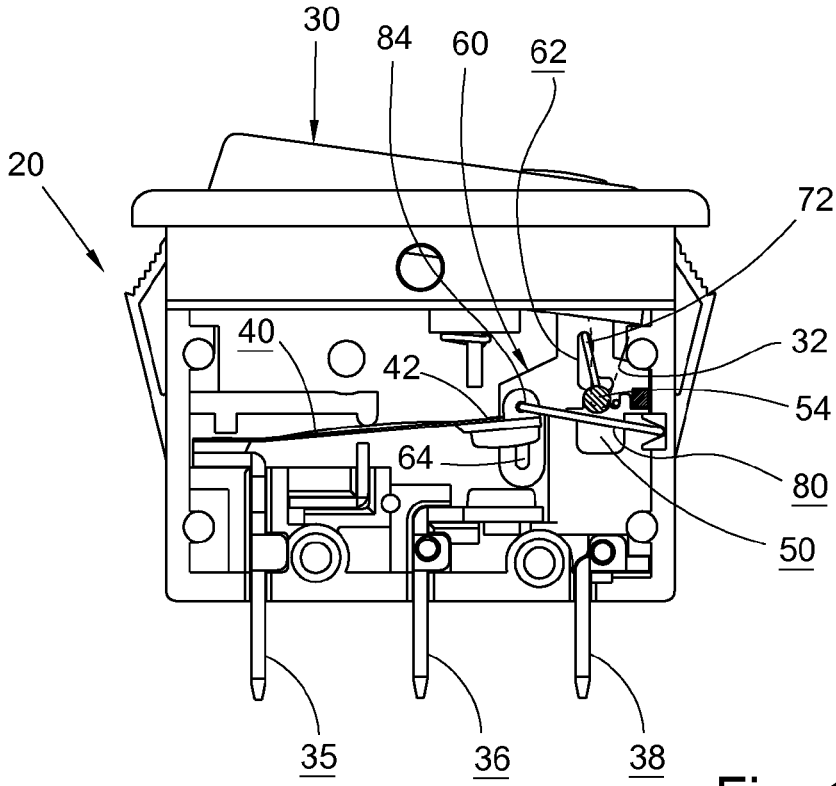

In case of current overload in the on state, the switch 10 will automatically switch off. Referring to FIG. 11, in case of current overload, the temperature of the conductive plate 40 will rise and the conductive plate 40 will automatically upcurl (bend up) and overcome the resilient force of the guide member 80. At this time, the contact end 42 of the conductive plate 40 separates from the second terminal 36 and drives the movable end 84 of the guide member to move upward along the straight slot 64 toward the top end thereof. As shown in FIG. 11, the slide block 60 is positioned in its home position without hindering the guide member 80 and the conductive plate 40 from moving upward. Therefore, in case of overload, even though the press button 30 is positioned in the closed position, the switch 10 itself still can automatically switch off to provide protection.

After switched off due to overload, press the press button 30 to the off position, the switch 10 is restored to the switched-off state as shown in FIGS. 3 and 8.

Figure 12:
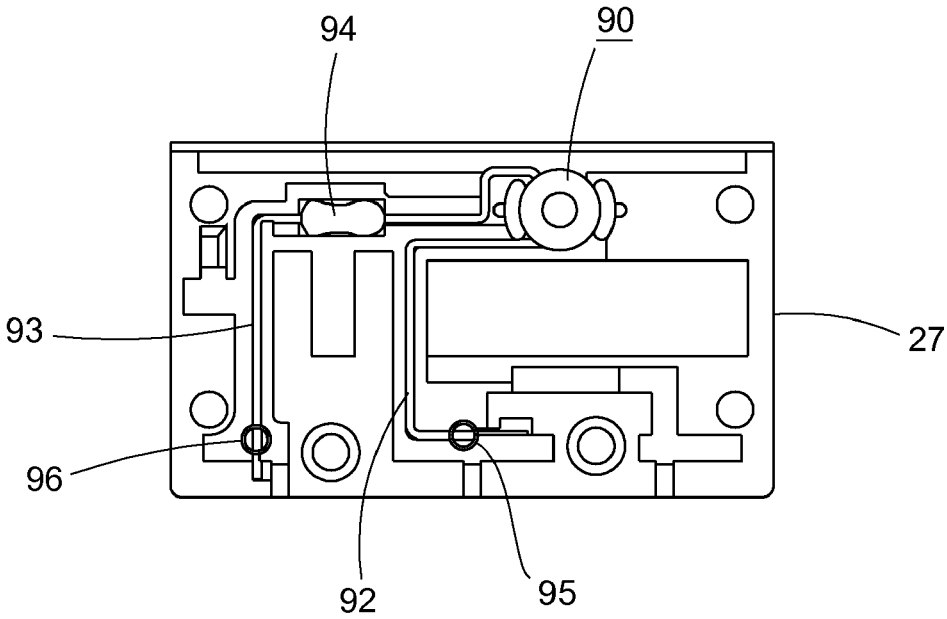
FIG. 12 is a rear view of a preferred embodiment of the present invention, showing some of the components thereof.
Figure 13:
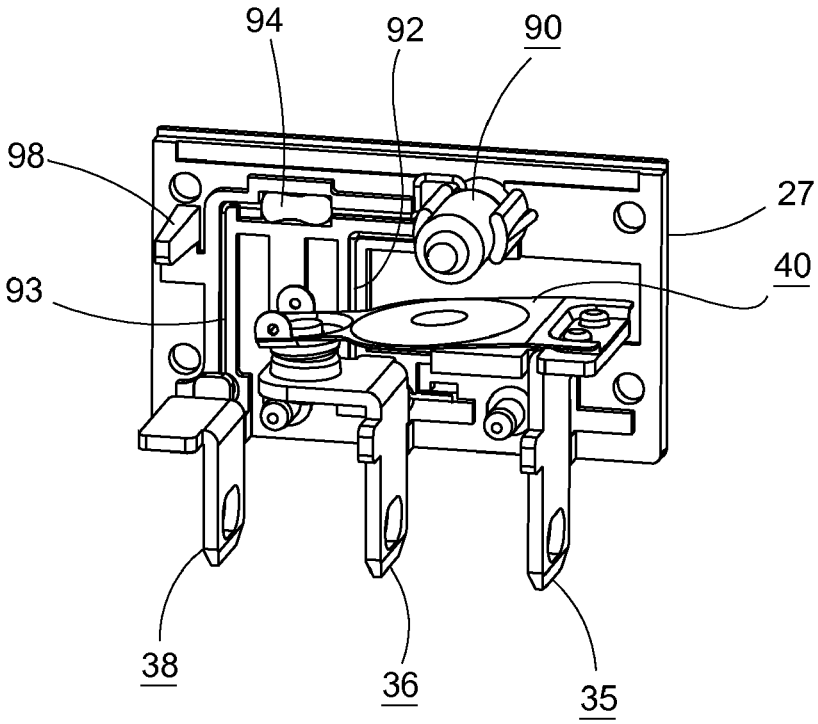
FIG. 13 is a rear perspective view of a preferred embodiment of the present invention, showing some of the components thereof.

Referring now to FIGS. 2, 12 and 13, the present invention further includes a light-emitting element 90, which is a neon lamp having two contact pins 92, 93. The neon lamp 90 and a resistor 94 are arranged on an inner face of a panel 27 of the main body 20. The two contact pins 92, 93 contact with the second terminal 36 and third terminal 38 via two conductive elements 95, 96 respectively.

The second and third terminals 36, 38 and the neon lamp 90 form a loop. When the switch 10 is switched on, the neon lamp 90 emits light. The light beam can pass through a transparent shade 39 arranged on the press button 30. When the switch 10 is switched off, the circuit of the second and third terminals and the neon lamp is opened so that the neon lamp will not emit light. By means of observing whether the neon lamp is turned on or off, a user can judge whether the switch 10 is switched on or off.

In addition, a restricting block 98 may be disposed on the inner face of the panel 27 as shown in FIG. 13. The restricting block 98 serves to restrict the slide block 50 to slide within a certain range as shown in FIG. 8.

Figure 14:
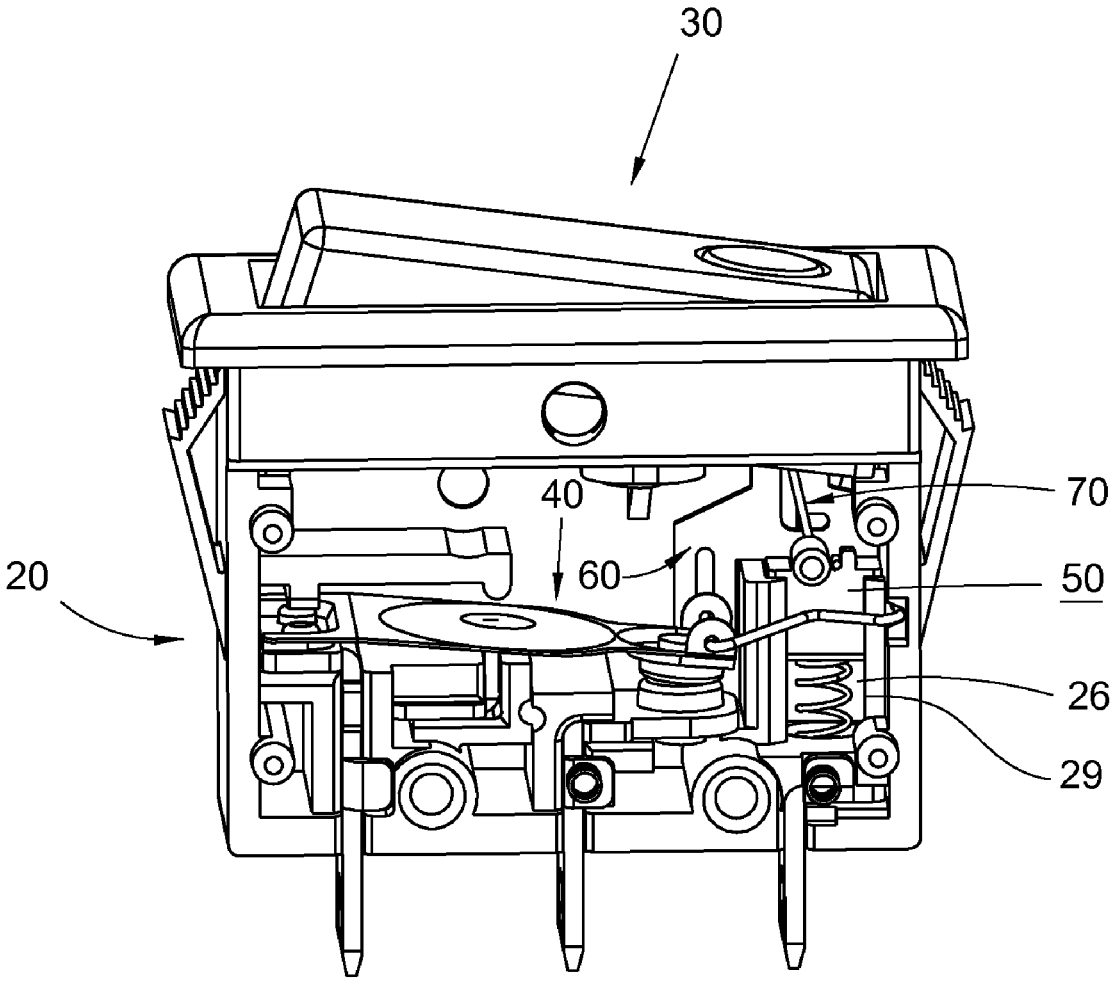
FIG. 14 is a front perspective view of still another embodiment of the present invention.

Moreover, referring to FIG. 14, the slide way 26 can have an open side 29 for facilitating assembling of the components.

Figure 15:
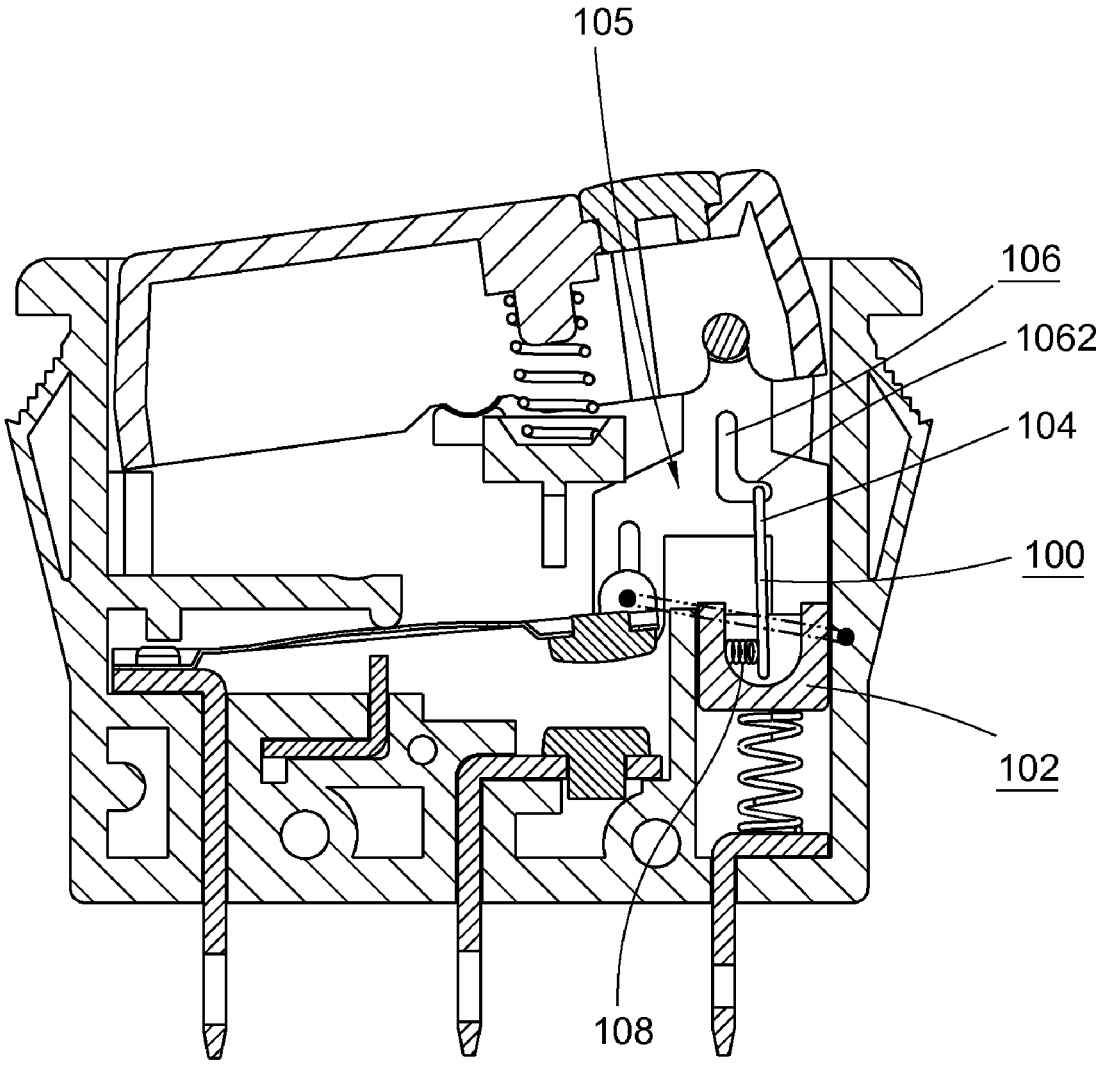
FIG. 15 is a sectional view of still another embodiment of the present invention.

The above embodiments are only used to illustrate the present invention, not intended to limit the scope thereof. Many modifications of the above embodiments can be made without departing from the spirit of the present invention. For example, the two contact pins of the neon lamp can be respectively connected to the first and second terminals to achieve the same turning on/off effect. Alternatively, referring to FIG. 15, the linking member 100 is a straight rod. A bottom end of the linking member 100 is pivotally connected with or located on the slide block 102. A top operation end 104 of the linking member 100 extends into the transmission slot 106 of the transmission member 105. A resilient member 108 is provided for abutting against the linking member 100 and urging the operation end 104 thereof to move to the close end of the transverse slot section 1062 of the transmission slot 106.

The overload protection switch of the present invention can be operated as a common switch. In case of current overload, the overload protection switch will automatically open the circuit to provide overload protection effect. Even if the press button is forcedly pressed into the on position, the overload protection switch can still automatically switch off without being affected.

What is claimed is:

1. An overload protection switch comprising:

a main body having an internal space in which multiple components of the overload protection switch are arranged; an opening disposed on a top face of the main body and communicating with the internal space; a vertical slide way being disposed in the main body;

a press button pivotally disposed in the opening of the main body, the press button being switchable between an open position and a closed position;

a first terminal and a second terminal disposed in the main body;

a conductive plate, which is a bimetal plate structure, one end of the conductive plate being connected with the first terminal, while another end of the conductive plate being a contact end, which is positioned above the second terminal and vertically swingable;

a slide block disposed in the slide way and slidable along the slide way; a resilient member being disposed between the main body and the slide block for resiliently supporting and lifting the slide block, whereby the slide block is always urged upward to a home position when no external force is applied to the slide block;

a transmission mechanism disposed between the press button and the slide block for drivingly connecting the press button and the slide block; and a resilient guide member having a located end, a movable end and the guide member being resiliently extensible between the two ends; the located end of the guide member being disposed in the main body within a swinging travel of the contact end of the conductive plate; the movable end of the guide member being vertically movable and connected with the contact end of the conductive plate; when the slide block is moved downward, the slide block drives the movable end of the guide member to move downward; when the movable end moves to a height approximately equal to a height of the located end, the guide member conserves an elastic potential energy;

when the switch is switched off, the slide block being positioned in the home position, in the state that the movable end of the guide member is higher than the located end; the contact end of the conductive plate being not in contact with the second terminal;

when switching the press button to the closed position, the transmission mechanism pushing and driving the slide block to move downward, the slide block pushing the guide member to move the movable end thereof downward; when the movable end of the guide member becomes lower than the located end thereof, the resiliently extension of the guide member makes the movable end move downward, whereby the movable end urges the contact end of the conductive plate to move downward and contact the second terminal; at the same time, the slide block being released from the pushing of the transmission mechanism and pushed by the resilient member to restore to the home position where the slide block is separated from the guide member by a distance and is not in contact with the guide member; and in case of overload, the contact end of the conductive plate bending up to separate from the second terminal and drive the movable end of the guide member to move upward to a position higher than the located end.

2. The switch as claimed in claim 1, wherein the transmission mechanism includes a transmission member and a linking member, wherein:

the transmission member has a top end connected with the press button, whereby the transmission member is drivable by the press button to vertically displace; the transmission member further having a transmission slot;

a bottom end of the linking member is substantially connected with the slide block; the linking member has an operation end extending into the transmission slot of the transmission member;

a shifting section is disposed under a bottom end of the press button;

when the switch is switched off, the operation end of the linking member is located at a bottom end of the transmission slot, whereby the transmission member and the linking member are synchronously downward movable; and when the switch is switched on, the shifting section of the press button shifts the operation end and releases the operation end from being located at the bottom end of the transmission slot, whereby the operation end being able to move along the transmission slot to release the slide block from being pushed by the linking member.

3. The switch as claimed in claim 2, wherein the transmission slot includes a vertical slot section and a transverse slot section communicating with a bottom end of the vertical slot section; the operation end being horizontally movable and resiliently restorable, whereby when the operation end is positioned at the bottom end of the transmission slot and no external force is applied to the operation end, the operation end is always urged to move from the vertical slot section into the transverse slot section; when the shifting section of the press button shifts the operation end, the operation end being moved from the transverse slot section to the vertical slot section, when the press button is positioned in the open position, the operation end of the linking member being positioned in the transverse slot section, when the press button is positioned in the closed position; the operation end moving along the vertical slot section to a top end thereof.

4. The switch as claimed in claim 3, wherein the linking member is a torque spring having a coiled section, a first leg and a second leg, the first and second legs being connected with the coiled section; the coiled section and the first leg being connected with the slide block; the second leg serving as the operation end.

5. The switch as claimed in claim 2, wherein the transmission member further has a vertical straight slot; the movable end of the guide member extending into the straight slot and being movable along the straight slot.

6. The switch as claimed in claim 2, wherein the operation end is on a top end of the linking member.

7. The switch as claimed in claim 1, wherein the slide block has a push section for pushing the guide member to move downward.

8. The switch as claimed in claim 1, wherein the guide member is a resilient elongated member.

9. The switch as claimed in claim 8, wherein the guide member has a bent section disposed between the ends.

10. The switch as claimed in claim 5, wherein the guide member is a resilient elongated member.

11. The switch as claimed in claim 1, wherein a locating section is disposed on an inner face of a wall of the main body; the located end of the guide member being located on the locating section.

12. The switch as claimed in claim 1, wherein the resilient member is positioned in the slide way and a top end of the resilient member abuts against the slide block.

13. The switch as claimed in claim 1, wherein the press button is light-transparent; the switch further comprising a light-emitting element disposed on the main body, the light-emitting element having two contact pins connected to the first and second terminals respectively.

14. The switch as claimed in claim 1, wherein the press button is light-transparent; the switch further comprising a third terminal and a light-emitting element disposed on the main body, the light-emitting element having two contact pins connected to the second and third terminals respectively.

* * * * *